United States Patent [19]

Knowles et al.

[11] 3,971,441

[45] July 27, 1976

[54] WELL COMPLETION IN PERMAFROST

[75] Inventors: Charles R. Knowles, Anchorage, Alaska; Leon H. Miles, Plano, Tex.; Larry N. Bell, Anchorage, Alaska

[73] Assignee: Atlantic Richfield Company, Los Angeles, Calif.

[22] Filed: Sept. 24, 1975

[21] Appl. No.: 616,502

[52] U.S. Cl. ..... 166/285; 166/312; 166/DIG. 1

[51] Int. Cl.[2] ..... E21B 33/13

[58] Field of Search ..... 166/DIG. 1, 285, 312, 166/57

[56] References Cited

UNITED STATES PATENTS

| | | | |
|---|---|---|---|
| 1,687,424 | 10/1928 | Boynton | 166/285 X |
| 3,464,493 | 9/1969 | Chancellor et al. | 166/285 |
| 3,791,448 | 2/1974 | Schuh | 166/DIG. 1 |
| 3,865,188 | 2/1975 | Doggett et al. | 166/285 |

*Primary Examiner*—Stephen J. Novosad
*Assistant Examiner*—George A. Suckfield
*Attorney, Agent, or Firm*—Roderick W. MacDonald

[57] ABSTRACT

A method for completing a well whose wellbore passes through a permafrost zone, the wellbore having at least one annulus in the permafrost zone, the annulus initially containing a freezable liquid. In the method openable and closable apertures are disposed near the bottom of the permafrost zone for achieving access between the interior of the wellbore and the annulus. Using these apertures, a hard collar, for example composed of cement, is emplaced in the annulus in the vicinity of said apertures. Thereafter the freezable liquid is displaced from the annulus above the collar using an essentially nonfreezable liquid which can be left in the annulus in the permafrost zone for the life of the well.

8 Claims, 5 Drawing Figures

WELL COMPLETION IN PERMAFROST

BACKGROUND OF THE INVENTION

Heretofore in drilling wells, including those in which the wellbore passes through a permafrost zone, water-based drilling fluids have been employed during the drilling procedure. These drilling fluids contain a major amount of water and therefore are freezable.

It is undesirable to leave freezable liquids in the permafrost part of a wellbore because, over the life of the well, the freezable liquid might be frozen and it is desirable that this be avoided.

Accordingly, it is desired to leave only essentially nonfreezable liquids in the wellbore in the area of the permafrost zone. It is just as desirable to continue drilling wells using water-based drilling mud. Therefore, it can be important to have a procedure for essentially completely displacing freezable liquid from portions of the wellbore. This can sometimes be difficult, particularly when the essentially nonfreezable liquid is lighter per unit volume than the water-based drilling mud because substantially complete displacement of a heavier liquid with a lighter liquid is difficult without using inordinate amounts of the lighter liquid.

SUMMARY OF THE INVENTION

According to this invention, there is provided a method for completing a well whose wellbore passes through a permafrost zone when at least part of the interior of the wellbore contains a freezable liquid particularly in the permafrost zone of the wellbore.

By the method of this invention, apertures are employed as described in more detail hereinafter near the bottom of the permafrost zone. A hardened collar is disposed in the annulus or annuli from which the freezable liquid is to be displaced. Thereafter freezable liquid above said collar is displaced using an essentially nonfreezable liquid thereby leaving in the one or more annuli of the wellbore displaced with essentially nonfreezable liquid in the permafrost portion of the wellbore. The essentially nonfreezable liquid used in this invention need not be unfreezable at all. Minor amounts of water can be tolerated, but reasonable efforts preferably are made so as to minimize the amount of water left behind in the permafrost zone of the wellbore. It should be understood that it is not necessary that all water be removed from the permafrost part of the wellbore.

When the freezable liquid which is to be removed is heavier and/or more viscous than the essentially nonfreezable liquid which is to replace the freezable liquid, special steps are taken, again involving the apertures referred to above, to wash the heavy freezable drilling fluid from the desired annulus of concern. The wash liquid is deliberately chosen so as to be lighter than the essentially nonfreezable liquid that is to follow it and sufficiently inexpensive so that copious amounts can be used to ensure essentially complete removal of the heavy freezable drilling fluid. After washing the drilling fluid from the annulus using the wash liquid, the wash liquid is then displaced with the relatively heavier essentially nonfreezable liquid. In this way the amount of water left in the treated annulus is kept to a minimum.

Accordingly, it is an object of this invention to provide a new and improved method for completing a well whose wellbore passes through a permafrost zone. It is another object to provide a new and improved method for enhancing the longevity of a well which is drilled through a permafrost zone using a freezable drilling fluid.

Other aspects, objects and advantages of this invention will be apparent to those skilled in the art from this disclosure and the appended claims.

DETAILED DESCRIPTION OF THE INVENTION

Figure 1:
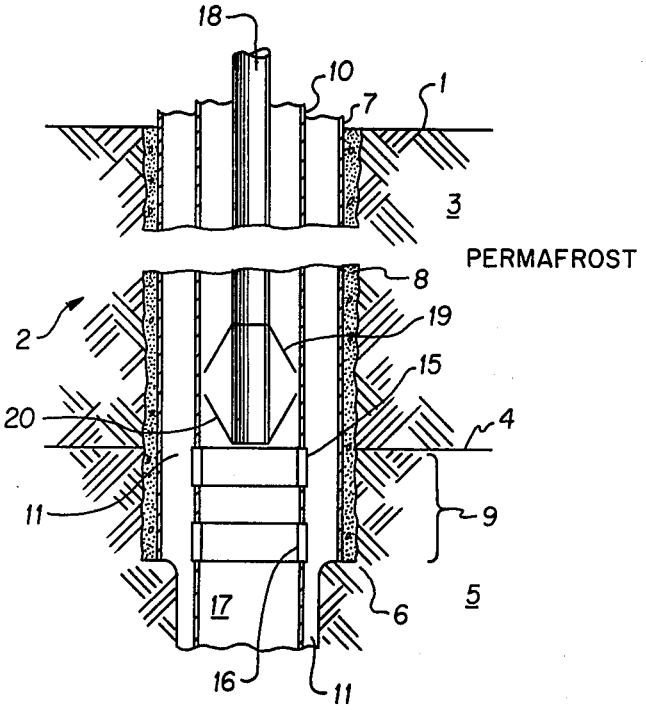
FIG. 1 shows a cross section of a wellbore passing through a permafrost zone, the wellbore containing apparatus useful in carrying out the method of this invention.

More specifically, FIG. 1 shows the earth's surface 1 having a wellbore 2 passing therethrough. Permafrost zone 3 is shown to extend over a substantial length of the wellbore. Below demarcation line 4 is unfrozen earth 5.

The wellbore, as shown in FIG. 1, comprises a longitudinally extending circular hole of relatively constant diameter down to shoulder 6 at which point the diameter of the wellbore decreases. In the upper larger diameter zone of the wellbore there has been set steel casing string 7 and any voids between the outer surface of casing 7 and the inner wall of wellbore 2 may have been filled with cement 8.

Casing 7 extends a finite distance 9 below the bottom of the permafrost zone to shoulder 6 where the wellbore narrows in width. Inside and essentially concentric with casing 7 is smaller diameter casing string 10 which extends from above the earth's surface to below shoulder 6 to yet another shoulder (not shown) where either the wellbore narrows again or the wellbore terminates.

Spaced apart casings 7 and 10 form a first annulus 11 which is defined at its exterior wall by casing 7 and at its interior wall by casing 10. Normally when this much of the well is completed or even when the entire well drilling procedure is completed, interior 17 of casing 10 as well as first annulus 11 are essentially full of drilling fluid. When, as is often the case, the drilling fluid is a water base material, first annulus 11 is essentially liquid-full of a freezable liquid in the permafrost area of the wellbore. It is desirable, in the permafrost zone of the wellbore, to remove this freezable liquid from first annulus 11.

Should, depending upon the depth of the wellbore, yet another string of casing similar to casing 10 but of smaller diameter be placed in the interior of casing 10, yet another annulus would be formed. Desirably, the freezable drilling fluid would be removed from this annulus too. Thus, although this invention will be described hereinafter in detail with respect to the removal of freezable liquid from only first annulus 11, it should be understood that the procedure of this invention can be repeated for however many annuli similar to first annulus 11 happen to be in the permafrost zone of the wellbore after drilling is completed for each size of casing.

FIG. 1 shows casing 10 to contain upper and lower aperture tool means 15 and 16, respectively, in an area near the bottom of permafrost zone 3 but yet below that permafrost zone. Aperture means 15 and 16 will be described hereinafter in greater detail but generally are spaced apart tools which have openings that can be opened and closed a number of times to provide or close off access between interior 17 of casing 10 and first annulus 11.

FIG. 1 also shows conduit means 18 which can be drill pipe, tubing, or any other sort of conduit which allows liquid communication between the earth's surface and any desired point in interior 17. Conduit 18 is longitudinally movable for as much of the length of the wellbore as is desired. In the particular embodiment of FIG. 1, although this is not required in the broad aspect of this invention, conduit 18 carries upper and lower fingers 19 and 20 which are used for opening and closing the apertures in aperture means 15 and 16.

Thus, in the stage of the well completion shown in FIG. 1, interior 17 for its full length and first annulus 11 for its full length are both essentially completely full of a freezable drilling fluid. It matters not that first annulus 11 contains freezable liquid below line 4, but, as explained above, it is desirable to remove freezable liquid from first annulus 11 above line 4. The method of this invention affects essentially complete removal of the freezable liquid from first annulus 11 above line 4 even when that freezable liquid is substantially heavier than the essentially nonfreezable liquid that is desired to replace the freezable liquid in first annulus 11.

Figure 2:
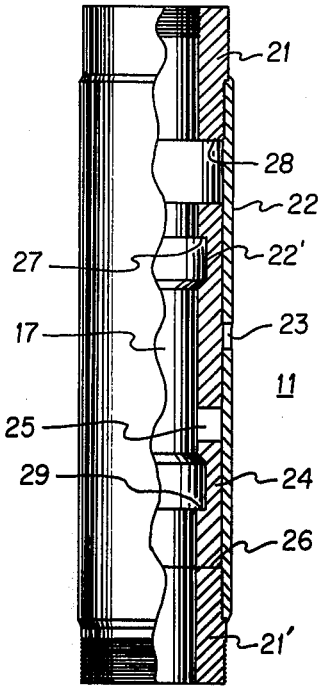
FIG. 2 shows a cross section of an aperture tool useful in the method of this invention.

FIG. 2 shows one of a number of suitable aperture tools useful as aperture means 15 and 16 of FIG. 1. The tool shown in FIG. 2 is commonly referred to as an FO tool and is well-known in the art. A full and complete disclosure of such a tool can be found in Halliburton Services Technical Data Sheet S-8074, dated January, 1973, the disclosure of which is incorporated herein by reference. Generally, the tool is composed of upper and lower sleeves 21 and 21', respectively, which are designed to be threadedly engaged with casing sections. Casing string 10 of FIG. 1 is composed of a plurality of casing sections that have been threadedly engaged to produce a single casing string of the length desired for the particular wellbore. Thus, sleeve 21 is fixed to an upper adjacent casing section while sleeve 21' is connected to an adjacent lower casing section thereby making the tool of FIG. 2 a part of the overall casing string 10. The tool has an outer sleeve 22 with one or more apertures 23 therein and an inner slidable sleeve 24 with one or more similar apertures 25. The tool as shown in FIG. 2 has sleeve 24 moved downwardly as far as it will go, i.e., until it hits and rests on stop 26. In this position apertures 23 and 25 are not aligned and the aperture tool is, therefore, closed. This is the configuration of the tool as initially disposed in the wellbore in accordance with this method, i.e., the apertures initially closed.

Apertures 23 and 25 of FIG. 2 can be brought into alignment, i.e., opened, to establish communication between interior 17 and first annulus 11. This is accomplished by engaging shoulder 27 and moving sleeve 24 upwardly until stopped by shoulder 28. The upward movement of sleeve 24 is accomplished by fingers 20 on conduit 18 in FIG. 1. Thus, to open the apertures of the tool in FIG. 2 conduit 18 is extended longitudinally into interior 17 until fingers 20 pass by shoulder 27 after which conduit 18 is raised until the ends of fingers 20 snap into slot 22' and bear against shoulder 27. Thereafter continued upward movement of conduit 18 causes sleeve 24 to be raised until its upward movement is stopped by shoulder 28. With yet further upward movement of conduit 18 fingers 20 are forced off of shoulder 27, the outer ends of fingers 20 having a slightly beveled surface (not shown) for this purpose as shown in the above-identified Technical Data Sheet.

To close the apertures after they have been opened, conduit 18 is merely lowered until fingers 19 engage shoulder 29 whereupon sleeve 24 is moved downward to stop 26 and apertures 23 and 25 once again moved out of alignment, i.e., closed. Suitable seal means (not shown) are employed between the sliding surfaces in the tool such as between the outside surface of sleeve 24 and the inside surface of sleeve 22 to provide a closed aperture which will withstand liquid pressure in interior 17, etc.

Figure 3:
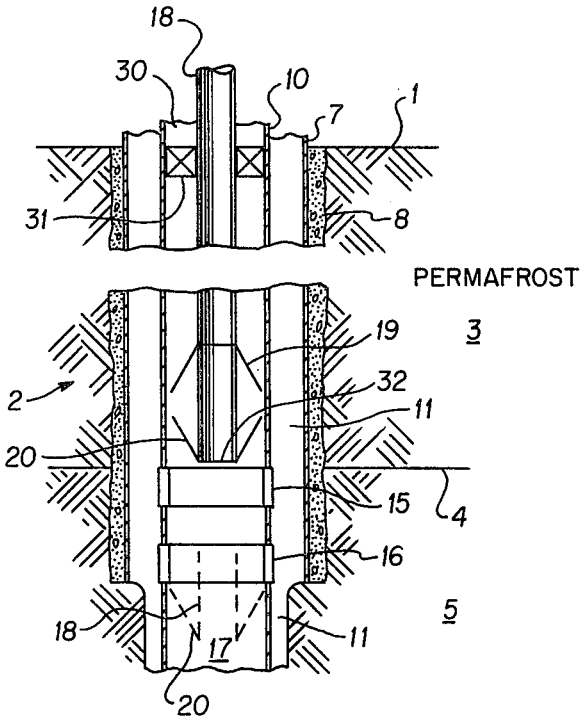
FIGS. 3 through 5 show cross sections of the well of FIG. 1 in various stages of carrying out the method of this invention.

Referring to FIG. 3, the insertion of conduit 18 into interior 17 of casing 10 forms a second annulus 30 which is defined on its inner side by conduit 18 and on its outer side by casing 10. In order to provide a pressure seal in second annulus 30 before any liquid is attempted to be pumped from the interior of conduit 18 through either or both of aperture tools 15 and 16 into first annulus 11, a conventional removable packoff 31 is used to close second annulus 30. This way a liquid under pressure exiting from lower end 32 of conduit 18 will not move upward in second annulus 30 but instead will be forced through apertures 15 or 16 if one or both are open. In this manner, liquid communication between the earth's surface and first annulus 11 is achieved by way of conduit 18 and either or both of aperture tools 15 and 16.

After packing off second annulus 30, conduit 18 still being longitudinally movable in the wellbore in a sealed manner with packoff 31, lower aperture tool 16 is opened by running conduit 18 into the wellbore until opening fingers 20 are below aperture tool 16 as shown by the phantom lines. Thereafter, conduit 18 is run out of the wellbore until fingers 20 are raised to the point where they abut shoulder 27 of FIG. 2. Additional raising of conduit 18 causes sleeve 24 to slide upward to stop 28 which results in apertures 23 and 25 being aligned.

With aperture tool 26 open, a hardenable fluid such as a conventional well cement can be pumped from the earth's surface through conduit 18 and through open lower aperture tool 16 into first annulus 11. This pumping of cement continues until the cement reaches upper aperture tool 15. At this point pumping of the cement is stopped and lower aperture tool 16 is closed.

Figure 4:
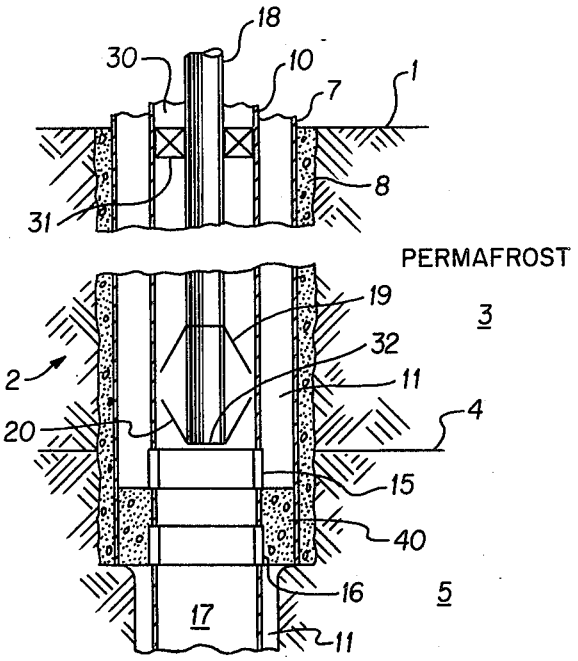
Figure 5:
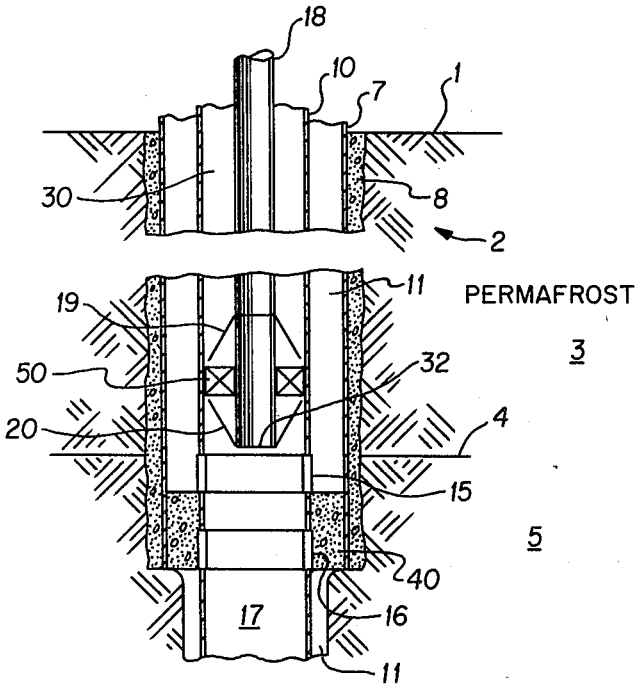

Thereafter, upper aperture tool 15 is opened and any cement that may have gotten into the apertures of tool 15 is washed out by circulating liquid through those apertures thereby leaving an annular cement collar 40 as shown in FIG. 4. Collar 40 extends from lower tool 16 up to but below the apertures of upper tool 15. This effectively seals the upper part of first annulus 11 which is in permafrost zone 3 from the lower part of first annulus 11 which is in the unfrozen earth zone 5.

It can also be good practice to wash out any residual cement in the interior of conduit 18 by reverse circulating liquid up conduit 18. For this procedure packoff 31 is removed and liquid pumped downwardly from the earth's surface through second annulus 30 to bottom 32 of conduit 18 and then upwardly to the earth's surface through the interior of conduit 18.

Before displacing freezable liquid from first annulus 11 in permafrost zone 3, second annulus 30 must again be packed off and, although packoff 31 could be located any place along the length of the wellbore or even at the earth's surface, it is preferable that the next packoff be located quite close to upper aperture tool 15 to minimize the amount of liquid below packoff 50 and above aperture tool 15. This is desirable since a substantial amount, if not all, of this liquid may eventually pass from interior 17 through aperture tool 15 into first annulus 11 and require removal along with the other freezable liquid already present in first annulus 11.

After again packing off second annulus 30 using packoff 50, nonfreezable liquid can be passed through conduit 18 and aperture tool 15 into first annulus 11 thereby forcing freezable liquid upward in annulus 11 to the earth's surface. If the freezable liquid in annulus 11 is heavier and/or more viscous than the essentially nonfreezable liquid which is to replace it, a wash liquid such as water can first be passed in copious amounts through conduit 18 and aperture tool 15 to wash essentially all of the freezable liquid from first annulus 11. Thereafter, the lighter wash liquid is displaced from first annulus 11 by the essentially nonfreezable liquid which is to remain in annulus 11 for the life of the well. The wash liquid can contain additives such as surfactants or thinners to aid in removing freezable liquid. The wash liquid can be freezable or not, the important consideration being that the wash liquid is relatively inexpensive and lighter than the essentially nonfreezable liquid that is to displace the wash liquid from first annulus 11.

When a light wash liquid is employed and is to be followed by a heavier essentially nonfreezable liquid, it is important to use conduit means 18 which is of relatively small diameter as compared to casing 10. For example, assume conduit 18 is not present in casing 10 and casing 10 is full of water after the washing procedure, when the heavier nonfreezable liquid is introduced at the top of casing 10, the heavier liquid (due to gravitational and other considerations) tends to bypass the water in casing 10. This can cause bypassed water to end up in annulus 11 after the method of this invention is completed. However, by use of relatively small diameter conduit 18 the tendency for the heavier nonfreezable liquid to bypass the lighter wash liquid is minimized thereby minimizing the possibility of leaving wash liquid in the annulus under treatment after the process is completed.

When the desired amount of freezable liquid has been displaced from first annulus 11 in permafrost zone 3, upper aperture tool 15 is closed so that first annulus 11 above collar 4 contains essentially nonfreezable liquid and below collar 40 contains freezable liquid. The above procedure can then be repeated for however many concentric annuli it is desired to displace freezable liquid from in the permafrost zone of the wellbore.

EXAMPLE

Wellbore 2 is drilled using a drilling fluid composed of a major amount of water and minor amounts of bentonite thickening agent and barite weighting agent so that interior 17 of casing 10 and first annulus 11 both are filled with this water-based drilling fluid. First annulus 11 is defined by standard 13 ⅜ inches casing 7 and standard 9 ⅝ inches casing 10 when disposed in a concentric manner as shown in FIG. 1.

Aperture tool 16 is opened and conventional oil well cement which takes several hours to harden is injected to form collar 40 after which aperture tool 16 is closed. Aperture tool 15 is then opened to allow excess cement that may be present outside aperture tool 15 to run from first annulus 11 through tool 15 into interior 17 and to the bottom of the wellbore. Also, packoff 31 is removed and drilling fluid reverse circulated down through second annulus 30 and up through drill string 18 to wash cement out of the interior of drill string 18. Thereafter, if desired, packoff 31 can be replaced and drilling fluid circulated from drill string 18 through aperture tool 15 to ensure that all cement is washed out of that aperture tool.

After the cement in collar 40 has hardened, packoff 50 is set, preferably within ten feet of aperture tool 15. The drilling fluid, because of the bentonite and barite added thereto, would be more dense than the diesel oil desired to be left in first annulus 11 as the nonfreezable liquid. After packoff 50 is set, the water-based drilling fluid in first annulus 11 above collar 40 is washed from that annulus using water without any additive. Large amounts of water are used to ensure that essentially all of the drilling fluid in annulus 11 above collar 40 is removed from that annulus, water normally being circulated until the returns from annulus 11 at the earth's surface show essentially no more drilling fluid being washed therefrom. In that situation first annulus 11 above collar 40 contains essentially only water with only minor amounts, if any, of drilling fluid remaining. Thereafter, diesel oil with weighting or thermal insulating additives added if desired is injected into the wellbore by way of drill string 18 and passes through aperture tool 15 into first annulus 11. The diesel oil displaces the water upwardly to the earth's surface until that annulus is essentially liquid-full of the nonfreezable diesel oil. Thereafter, aperture tool 15 is closed.

Reasonable variations and modifications are possible within the scope of this disclosure without departing from the spirit and scope of this invention.

The embodiments of the invention in which an exclusive property or privilege is claimed are defined as follows:

1. A method for completing a well whose wellbore passes through a permafrost zone, said wellbore containing a freezable liquid, said method providing in the permafrost zone of said wellbore a longitudinally extending first annulus having inner and outer walls, said inner wall defining a longitudinally extending interior zone, providing near the lower end of said permafrost zone spaced apart upper and lower openable and closable aperture means in said inner wall, the apertures in both said aperture means being initially closed, providing a longitudinally movable conduit means for conducting fluid from the earth's surface to the vicinity of said apertures, running said conduit means into said interior zone thereby providing a second annulus between said conduit means and said inner wall, packing off said second annulus above said upper aperture means, opening said lower aperture means, pumping a hardenable fluid through said conduit means and through said lower aperture means into said first annulus, continuing said pumping until said hardenable fluid reaches said upper aperture means, closing said lower aperture means, opening said upper aperture means, washing hardenable fluid if any out of said upper aperture means thereby leaving a hardenable annular collar in said first annulus between said upper and lower aperture means, allowing said collar to harden, and injecting into said first annulus above said collar by way of said conduit means and upper aperture means essentially nonfreezable liquid under the conditions present in said permafrost zone of said wellbore thereby substituting said essentially nonfreezable liquid for said freezable liquid in the permafrost area of said annulus.

2. The method of claim 1 wherein said hardenable fluid is cement.

3. The method of claim 1 wherein after said lower aperture means is closed and before said upper aperture means is opened said second annulus packoff is opened and reverse circulation of liquid present is carried out from said second annulus into said conduit means and then up to the earth's surface through said conduit means to remove hardenable fluid from the interior of said conduit means.

4. The method of claim 3 wherein said second annulus is packed off after said reverse circulation through said conduit means and before said upper aperture means is opened, said second packoff being accomplished above but close to said upper aperture means to minimize the amount of freezable liquid in said second annulus that is below said second packoff thereby minimizing the amount of such liquid that can pass from said second annulus through said upper aperture means into said first annulus.

5. The method of claim 1 wherein said freezable liquid is heavier than said essentially nonfreezable liquid, and before injection of said essentially nonfreezable liquid, said freezable liquid is washed out of said first annulus using copious amounts of a wash liquid, said wash liquid being lighter than said essentially nonfreezable liquid so that said essentially nonfreezable liquid will more completely displace said wash liquid.

6. The method of claim 5 wherein said freezable liquid is a water-based drilling fluid, said hardenable fluid is cement, said wash liquid is water, and said essentially nonfreezable liquid is a hydrocarbon based liquid.

7. The method of claim 1 wherein said aperture means are openable and closable by a tool carried by said conduit means.

8. The method of claim 1 wherein said conduit means is of relatively small diameter as compared to said interior zone.

* * * * *

UNITED STATES PATENT OFFICE
CERTIFICATE OF CORRECTION

PATENT NO. : 3,971,441

DATED : July 27, 1976

INVENTOR(S) : Charles R. Knowles, Leon H. Miles, & Larry N. Bell

It is certified that error appears in the above-identified patent and that said Letters Patent are hereby corrected as shown below:

Column 7, line 2, insert after the word "said" the word ---first---.

Signed and Sealed this

Twelfth Day of October 1976

[SEAL]

*Attest:*

RUTH C. MASON
*Attesting Officer*

C. MARSHALL DANN
*Commissioner of Patents and Trademarks*